United States Patent [19]

Görike

[11] 4,389,542

[45] Jun. 21, 1983

[54] ORTHODYNAMIC HEADPHONE

[75] Inventor: Rudolf Görike, Vienna, Austria

[73] Assignee: AKG Akustische u. Kino-Geräte, Austria

[21] Appl. No.: 261,151

[22] PCT Filed: Aug. 18, 1980

[86] PCT No.: PCT/AT80/00026

§ 371 Date: Apr. 23, 1981

§ 102(e) Date: Apr. 21, 1981

[87] PCT Pub. No.: WO81/00660

PCT Pub. Date: Mar. 5, 1981

[30] Foreign Application Priority Data

Aug. 23, 1979 [AT] Austria ..... 5675/79

[51] Int. Cl.[3] ..... H04R 3/00; H04R 9/06; H04R 19/04

[52] U.S. Cl. ..... 179/1 R; 179/182 R

[58] Field of Search ..... 179/182 R, 1 R; 128/152, 154; 181/133, 136, 129, DIG. 1

[56] References Cited

U.S. PATENT DOCUMENTS

| | | | |
|---|---|---|---|
| 4,005,278 | 1/1977 | Görike | 179/181 R |
| 4,158,753 | 6/1979 | Görike | 179/182 R |
| 4,278,852 | 7/1981 | Görike | 179/182 R |

*Primary Examiner*—G. Z. Rubinson
*Assistant Examiner*—Robert Lev
*Attorney, Agent, or Firm*—McGlew and Tuttle

[57] ABSTRACT

Headphone earpieces which comprise each at least one electroacoustic transducer operating on the orthodynamic principle and including a small-mass diaphragm of an extension corresponding at least to that of an average auricle, with the coupling space of each of the earpieces being designed for a minimum reflection, are equipped with an ear cushion which, with the headphone in position of use, tightly encloses the coupling space toward the outside.

The disadvantages of headphone with an orthodynamically driven diaphragm which have hitherto been used only with the coupling space tightly enclosed, may be eliminated by omitting the tight enclosure of the coupling space and effecting the coupling to the ear by means of an ear cushion (1) of reticulate foam material by which the coupling space is enclosed at least laterally and which, while resting against the ear (2) or the user's head, has an acoustic frictional resistance approximately of the order of magnitude of the transformed wave impedance of air, so that the diaphragm (3) oscillation is impeded predominantly by friction and the critical damping of the low-frequency resonance (70 to 300 Hz) of the diaphragm is insured.

12 Claims, 7 Drawing Figures

ORTHODYNAMIC HEADPHONE

FIELD AND BACKGROUND OF THE INVENTION

The present invention relates to a headphone having earpieces which each comprise at least one electro-acoustic transducer operating on the isodynamic principle and including a small-mass diaphragm at least corresponding in size to an average auricle, and in which headphone the coupling space of each of the earpieces is designed for minimum sound reflection.

Headphones of the isodynamic type are equipped with an ear cushion which, with the headphone in use, closes the coupling space tightly to the outside. In headphones with moving-coil systems however, the so-called open design is also usual in addition to those using a tight enclosure above the ears. If a headphone with the dynamic transducer systems and diaphragms having minimum masses is operated with a tightly closed coupling space, the restoring force of the air enclosed in the coupling space causes the diaphragm resonance to rise to between 1,500 to 4,000 Hz, regardless of the fundamental resonance of the diaphragm which may range between 70 and 250 Hz even with attachment on all sides. Such diaphragms, for example, use a polyester foil having a thickness of 6 microns and are provided with a 6 micron thick conducting coating of aluminum extending over the entire surface area thereof, with the surface area of the diaphragm corresponding at least to the extension of an average auricle. This means that in the range between 0 and 1,500 or 4,000 Hz, the diaphragm is elastically impeded and oscillates with a constant amplitude if the driving force is constant and independent of the frequency. This results in a constant pressure in the closed coupling space. Above this critical resonance frequency, the amplitude would decrease with frequency, however the diaphragm, due to its extension, emits directional sound waves, which again result in a linear response of the headphone. A linear response therefore implies the requirement of a very small mass of the diaphragm, a very low fundamental resonance of the diaphragm, and a strong restoring force in the tightly enclosed coupling space. It is noted that elastic impedance is caused by an air cushion in the coupling space which acts like a spring against the diaphragm.

In practice, however, some difficulties arise in the use of headphones of the above described kind and with a tight closure of the coupling space. These difficulties hinder high-quality sound transmission and can be overcome only in an expensive way. The difficulties particularly involve acoustic disturbances in the coupling space caused by the sealing ear cushion whose inside surfaces can hardly be made non-reflecting, which has the effect that the acoustic event is localized "close to the ear" or "in the ear". Compensating means such as acoustic frictional resistances built into the frame surrounding the ear are very costly.

SUMMARY OF THE INVENTION

The objective of the present invention is to eliminate the disadvantages of headphones designed with an isodynamically driven diaphragm, which have hitherto been operated only with the coupling space tightly enclosed in a position of use, by omitting a tight enclosure of the coupling space. In the inventive design, the sound is allowed to exit from the coupling space through an acoustic frictional resistance. In consequence, the elastically impeded transducer system becomes a predominantly friction-impeded system. This means that the diaphragm with its low fundamental resonance, oscillates at a constant velocity, so that by closing the coupling space with an acoustic resistance on the order of magnitude of the wave impedance of air, a constant sound pressure can be produced in the coupling space.

It is therefore a particularly characteristic feature of the invention that to effect a coupling to the ear, a cushion of foam material is provided by which the coupling space is bounded at least laterally and which, while resting against the user's ear or head, has an acoustic frictional resistance approximately on the order of magnitude of the transformed wave impedance of air, so that the oscillations of the diaphragm are predominantly impeded by friction and the requirement of a critical damping of the low frequency resonance of the diaphragm (70 to 300 Hz) is satisfied.

By "transformed wave impedance of air", the square of the ratio of the surface area of the diaphragm to the cross-sectional area of all passages through the foam cushion is to be understood. The foam cushion acts as the acoustic frictional resistance. The smaller the mass of the diaphragm and the lower the natural resonance of the diaphragm, the lower the damping resistance can be. Even slight reflective properties of the diaphragm are thereby suppressed. This diaphragm is damped conjointly by the acoustic frictional resistance of the foam cushion and by an acoustic frictional resistance which may be provided behind the diaphragm. Measurements have shown that foam cushions placed at the ear do not disturbingly affect the ear resonances.

A headphone is known with electrostatic (capacitor) transducers wherein the earpieces are provided with a single strip of foam material unilaterally arranged at the periphery of a very large diaphragm assembly. The electrostatic system when adjusted to relatively high frequencies, however, proved unsatisfactory in headphones because the reproduction of base tones was too weak. The adjustment to high frequencies is inevitably connected to the necessity of providing a small distance between the electrodes (that is the diaphragm and its counteracting fixed metal disc), to obtain a high efficiency, and to the attraction between the electrodes at rest in the electrostatic system. In addition, the diaphragm is surrounded by a very broad frame causing reflections in use, due to its position relative to the ear and linearly distorting the ear resonances. This is contrary to the requirement of eliminating reflections on which the invention is based. The use of isodynamic systems on the other hand, makes it easily possible in practice to provide any low fundamental resonance of the diaphragm, since no at rest attraction occurs. Consequently, with the inventive frictional closure of the coupling space as explained in the foregoing, a completely satisfactory reproduction of base tones is obtained, while the reproduction of high and highest frequencies remains unaffected. The inventive cushion of reticulate foam material which may be arranged relatively of or around the diaphragm of the transducer or even as a thin layer in front of the diaphragm, does not require any supporting elements and rests against the ear or the head while enclosing the ear. The cushion may in addition be coated with a thin sound transmitting tissue serving the purpose of making contact with the skin more agreeable. It is further possible to provide the outer surface of the cushion with a thin elastic skin to accumulate the base reproduction without causing reflections.

The advantageous effect of the inventive cushion of reticulate foam material which, in contradistinction to prior art dense ear cushions, offers only a very small acoustic friction resistance is based on the provision that the respective damping factor corresponds to the critical damping of the diaphragm resonance which ranges between 70 and 300 Hz due to the very small mass and very small restoring force of the diaphragm. Unlike in headphones with a moving coil system and cushions of a reticulate foam material, no acoustically stiff surfaces are present in the inventive design. In moving-coil systems, the transducer is located in the zone of the auricle so that reflections occur at the diaphragm or magnetic system, by which the ear resonances are so varied that the acoustic event moves close to the ear. Moreover, in moving-coil systems, the diaphragm oscillations cannot be influenced by the foam cushion, so that a high acoustic frictional resistance is needed behind the relatively heavy diaphragm. Experience has further shown that in practice, the impedance of the ear drum does not affect the oscillator behavior of the diaphragm of an isodynamic system. What is important for the oscillatory behavior of the diaphragm is only the ohmic load by the inventive cushion of reticulate foam material provided between the diaphragm and the ear. The foam cushion is preferably of annular shape and it may be advisable to provide a low acoustic frictional resistance also behind the diaphragm, in addition to the foam cushion, to critically damp the diaphragm oscillations. The foam cushion may take various shapes and also the reticulate structure of the foam material may vary if special acoustic properties are desired in view of the acoustic event to be transmitted. This also applies to the diaphragm which, preferably, is driven over its entire surface area, however, may also be driven partially, with the individual surface areas being operated differently, depending on the level and/or frequency response and/or delay time.

The isodynamic system offers the possibility of sectioning the conductive tracks and electrically supplying them separately. Since the diaphragm is extremely light and under a very low mechanical tension, each portion of the diaphragm independently performs a motion which depends on the respective electrical drive. This makes it possible to transmit to the auricle, acoustic signals which are analogous to a natural hearing with free ears. If the diaphragm portion at the front part of the auricle is supplied without delay and/or attenuated level, while the diaphragm portion facing the rear part of the auricle is supplied with delay and/or attenuated level, especially of the higher frequencies, the acoustic event may become localized in the front. The prerequisite is the absence to a large extent of reflections in the coupling space and behind the diaphragm or behind a frame provided at the periphery of the diaphragm. If, due to reflections, linear distortions of the ear signal occur which result in coherent ear signals such as envelope curves or the like, then the acoustic event migrates into the listener's head. With a further sectioning of the diaphragm drive, any acoustic impression of free hearing may be simulated. Instead of sectioning the electrical drive of the diaphragm, sound absorbing means, such as felt, may be provided in front of the diaphragm portion in the rear zone of the auricle, to clip the higher frequencies, for example.

DETAILED DESCRIPTION OF PREFERRED EMBODIMENTS

Figure 1:
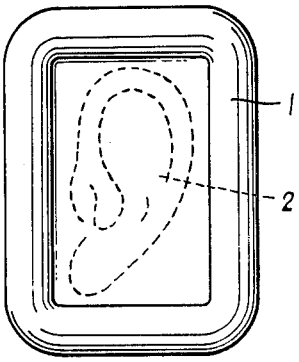
FIG. 1 is a diagrammatical side elevational view of the inventive ear cushion.
Figure 2:
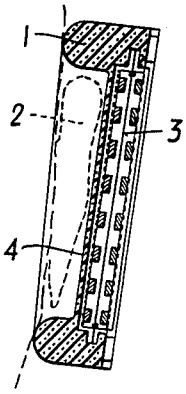
FIG. 2 is a diagrammatic sectional view of an inventive ear cushion.

In the embodiment shown in FIG. 1, the ear cushion 1 is designed as a rectangular frame surrounding the user's ear 2. In the embodiment of FIG. 2 showing an inventive earpiece in section as viewed from above, an ear cushion 1 is provided in addition with a thin layer 4 extending between diaphragm 3 and the ear 2 and contributing to the critical damping of the diaphragm oscillations.

Figure 3:
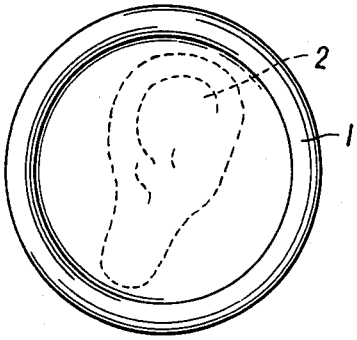
FIG. 3 is a side elevational view of an annular ear cushion according to another embodiment of the invention.

The embodiment shown in FIG. 3 differs from the embodiment of FIG. 1 only in that ear cushion 1 surrounds the user's ear 2 circularly.

Figure 4:
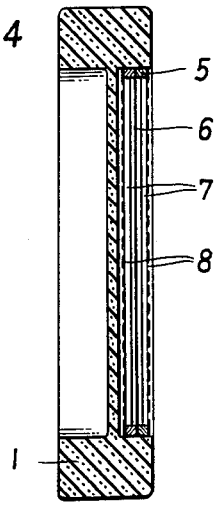
FIG. 4 is a diagrammatical sectional view of a headphone equipped in accordance with the invention.

In the sectional view of FIG. 4, the cushion of reticulate foam material is indicated at 1. In a shallow reflection-free frame 5, a diaphragm 6 is secured which is made of a polyester foil having a thickness of about 5 microns and provided with conducting aluminum tracks which are deposited by evaporation or printed in a thickness of about 6 microns. The magnetic bars 7 are secured to two opposite perforated iron sheets 8 and spaced from diaphragm 6 by a distance of about 0.5 mm to allow for a sufficient amplitude of diaphragm 6 while reproducing low frequencies. FIG. 4 clearly shows that no sound reflecting surfaces are present anywhere in the headphone. Therefore, no linear distortions of the ear resonances occur. Iron sheets 8 may be braced against each other at the periphery by spacers or bent in that zone to eliminate any reflection.

Figure 5:
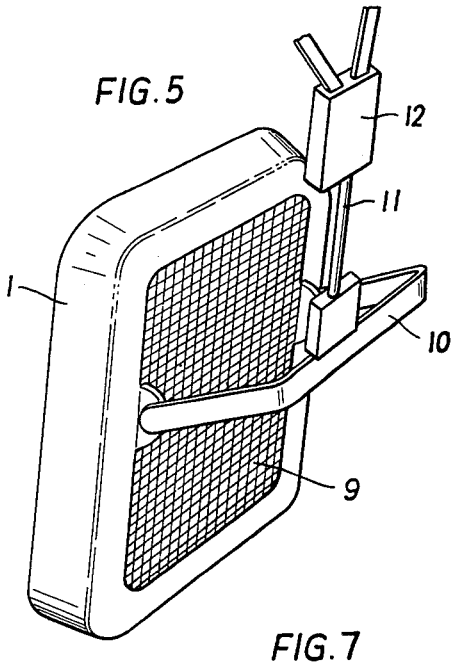
FIG. 5 is a perspective view showing one side of the headphone of FIG. 4.
Figure 6:
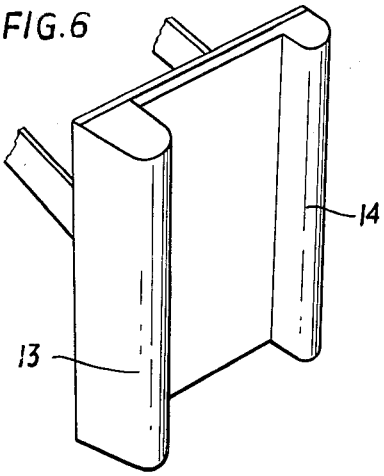
FIG. 6 is a perspective view which shows an earpiece with vertically extending strips of reticulate foam material.
Figure 7:
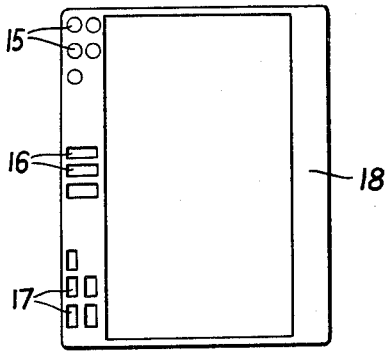
FIG. 7 shows an element for supporting the cushion of reticulate foam material of FIG. 6.

FIG. 5 shows one of the two connected parts of a headphone in accordance with the invention. Neither ear cushion 1 nor the sound transmitting grille 9 nor any other element of the phone cause any disturbing reflections which would otherwise occur if surfaces even of smallest size, such as of the order of magnitude of 2 $cm^2$, were present close behind the diaphragm. Parts 10, 11, 12 are conventional component parts of a headband. Another advantageous embodiment of the invention in which only two vertical strips of reticulate foam material are provided laterally of the diaphragm arrangement is shown in FIG. 6, whereby vertical ventilation is obtained to avoid heat accumulation at the ear. Musical programs may then be listened to without inconvenience for longer periods of time. According to FIG. 6, the strips of reticulate foam material 13, 14 are provided at the edges of the transducer system. The frame or strips of foam material are supported by grids or perforated sheets of metal or plastic allowing a maximum flow of air therethrough, shapes of perforations being shown at 15, 16, 17, 18 of FIG. 7.

Due to the inventive provisions, no sensation of a foreign body present at the ears or proximate thereto is perceived upon putting the headphone on, while with conventional headphones, the user has the impression of being secluded.

What is claimed is:

1. A headphone having earpieces which each comprise at least one electroacoustic transducer operating on the isodynamic principle and including a small-mass diaphragm corresponding at least to the area of an average auricle, with a coupling space of each of the earpieces being designed for minimum sound reflection, characterized in that in order to effect a coupling to the ear, a cushion of reticulate foam material is provided bounding the coupling space at least laterally and having an acoustic frictional resistance which, with the cushion resting in a use position to form the coupling space, is approximately on the order of magnitude of the transformed wave impedance of air, so that the diaphragm oscillation is impeded predominantly by friction and a critical damping of the low-frequency resonance of the diaphragm is established.

2. A headphone according to claim 1, characterized in that the foam cushion is provided in addition with a thin layer which extends across the cushion and is made of material having similar acoustic properties, within position of use, the layer is located between the auricle and the diaphragm.

3. A headphone according to claim 1, characterized in that the foam cushion has an annular shape.

4. A headphone according to claim 1 characterized in that the ear cushion is coated with a thin tissue that fully transmits sound.

5. A headphone according to claim 1, characterized in that an outer circumferential surface of the ear cushion is provided with a thin elastic skin.

6. A headphone according to claim 1, characterized in that bracing elements supporting the foam cushion and permeable to sound to a large extent are provided.

7. A headphone according to claim 1, characterized in that the diaphragm is electrically driven by sections.

8. A headphone according to claim 1, characterized in that sound absorbing means are provided in front of the diaphragm.

9. In a headphone earpiece having an electroacoustic transducer operating on the isodynamic principle and including a low mass diaphragm having an area at least that of an auricle of a user, and a cushion for defining a coupling space with the head of a user in a use position of the ear piece, the improvement comprising:

the coupling space structured to provide minimum sound reflection therein; and the cushion made of reticulate foam material to establish an acoustic frictional resistance from inside the coupling space to an exterior thereof, the foam material being chosen to have a frictional resistance which is on an order of magnitude of the transmitted wave impedance of air.

10. In a headphone earpiece, the improvement according to claim 9, wherein the cushion of reticulate foam material has a total cross-sectional through passage area, the diaphragm having an area, the transformed wave impedance of air being defined as the square of the ratio of diaphragm surface area to cross-sectional total passage area of the foam material.

11. In a headphone earpiece, the improvement of claim 10, wherein said cushion is annular and surrounds an auricle in a use position of the headphone earpiece.

12. In a headphone earpiece, the improvement according to claim 10, wherein said cushion includes at least two spaced cushion portions leaving a portion of the coupling space open.

* * * * *

UNITED STATES PATENT OFFICE

CERTIFICATE OF CORRECTION

Patent No. 4,389,542 Dated June 21, 1983

Inventor(s) Rudolf Görike

It is certified that error appears in the above-identified patent and that said Letters Patent are hereby corrected as shown below:

On the title page delete Item "/73/ Assignee:"

Signed and Sealed this

Sixteenth Day of April 1985

[SEAL]

*Attest:*

DONALD J. QUIGG

*Attesting Officer* *Acting Commissioner of Patents and Trademarks*